US010056163B2

(12) United States Patent
Bertholdt et al.

(10) Patent No.: US 10,056,163 B2
(45) Date of Patent: Aug. 21, 2018

(54) METHOD FOR DISSOLVING AN OXIDE LAYER

(71) Applicants: Horst-Otto Bertholdt, Nuremberg (DE); Andreas Loeb, Niddatal (DE); Hartmut Runge, Alzenau (DE); Dieter Stanke, Schollkrippen (DE)

(72) Inventors: Horst-Otto Bertholdt, Nuremberg (DE); Andreas Loeb, Niddatal (DE); Hartmut Runge, Alzenau (DE); Dieter Stanke, Schollkrippen (DE)

(73) Assignee: SIEMPELKAMP NIS INGENIEURGESELLSCHAFT MBH, Alzenau (DE)

( * ) Notice: Subject to any disclaimer, the term of this patent is extended or adjusted under 35 U.S.C. 154(b) by 1012 days.

(21) Appl. No.: 14/346,127

(22) PCT Filed: Sep. 20, 2012

(86) PCT No.: PCT/EP2012/068485
§ 371 (c)(1),
(2) Date: Aug. 5, 2014

(87) PCT Pub. No.: WO2013/041595
PCT Pub. Date: Mar. 28, 2013

(65) Prior Publication Data

US 2014/0352717 A1 Dec. 4, 2014

(30) Foreign Application Priority Data

Sep. 20, 2011 (EP) ..... 11181978
Sep. 26, 2011 (DE) ..... 10 2011 083 380
Oct. 17, 2011 (DE) ..... 10 2011 084 607

(51) Int. Cl.
*G21F 9/00* (2006.01)
*G21F 9/28* (2006.01)
(Continued)

(52) U.S. Cl.
CPC ..... *G21F 9/004* (2013.01); *G21F 9/28* (2013.01); *G21F 9/30* (2013.01)

(58) Field of Classification Search
None
See application file for complete search history.

(56) References Cited

U.S. PATENT DOCUMENTS 3,873,362 A 3/1975 Mihram et al.
4,481,040 A * 11/1984 Brookes ..... G21F 9/004 134/13
(Continued)

FOREIGN PATENT DOCUMENTS

DE 69312966 T2 2/1998
EP 0406098 A1 1/1991
(Continued)

OTHER PUBLICATIONS

EP 04006098 English Translation, accessed in Mar. 2017.*
(Continued)

*Primary Examiner* — Eric W Golightly
*Assistant Examiner* — Arlyn I Rivera-Cordero
(74) *Attorney, Agent, or Firm* — Ladas & Parry LLP; Malcolm J. MacDonald

(57) ABSTRACT

The invention relates to a method for dissolving an oxide layer containing chromium, iron, nickel, and radionuclides by means of an aqueous oxidative decontamination solution, which contains permanganic acid and a mineral acid and which flows in a circuit (K1), wherein the oxidative decontamination solution is set to a pH value ≤2.5.

28 Claims, 7 Drawing Sheets

(51) Int. Cl.

| | |
|---|---|
| ***G21F 9/30*** | (2006.01) |
| ***C23G 1/02*** | (2006.01) |
| ***B08B 9/00*** | (2006.01) |

(56) References Cited

U.S. PATENT DOCUMENTS

| | | | | |
|---|---|---|---|---|
| 2004/0035443 | A1 | 2/2004 | Yaita et al. | |
| 2006/0167330 | A1* | 7/2006 | Enda | G21F 9/28 588/1 |

FOREIGN PATENT DOCUMENTS

| | | | |
|---|---|---|---|
| EP | 1054413 | A2 | 11/2000 |
| WO | 2007062743 | A2 | 6/2007 |

OTHER PUBLICATIONS

International Search Report dated Dec. 7, 2012, corresponding to International Application No. PCT/EP2012/068485.
German Search Report dated Jul. 27, 2012, corresponding to German Patent Application No. DE 102011084607.7.

* cited by examiner

*K1 = Primary system circuit*
DE = Steam generator
DRB = reactor pressure vessel
HKMP = Main coolant pump

*K2 = bypass circuit for removing dissolved cations*
*K3 = bypass circuit for removing dissolved anions*
KIT = cation exchange resin container
AIT = anion exchange resin container

METHOD FOR DISSOLVING AN OXIDE LAYER

This application is a 371 of PCT/EP2012/068485, filed on Sep. 20, 2012, which claims priority to European Application No. 11181978.5 filed Sep. 20, 2011, German Application No. 102011083380.3 filed Sep. 26, 2011 and No. 102011084607.7, filed Oct. 17, 2011.

BACKGROUND OF THE INVENTION

The invention relates to a method for dissolving an oxide layer containing chromium, iron, nickel, and optionally zinc and radionuclides using an aqueous oxidative decontamination solution containing permanganic acid and a mineral acid, flowing in a circuit (K1), wherein the oxidative decontamination solution is adjusted to a pH ≤2.5, especially for decomposing oxide layers deposited on the interior surfaces of areas or components of a nuclear power plant.

The invention particularly relates to a method for extensive decomposition of the radionuclides in the primary system and the auxiliary system in a nuclear power plant using the available operating medium and the operating system of the power plant itself.

During the generating operation of a PWR (pressurized water reactor) nuclear power plant, with an operating temperature of >180° C. and reducing conditions on the interior surfaces of the systems and components wetted by the medium, oxidic protective layers (Fe0.5Ni1.0Cr1.5O4, NiFe2O4) are formed. In this process, radionuclides are incorporated into the oxide matrix as well. The goal of chemical decontamination methods is to break down this oxide layer in order to remove the incorporated radionuclides. The goal of this procedure is to minimize the radiation exposure of the maintenance staff in case of a maintenance operation insofar as possible, or in the case of dismantling of the nuclear reactor, to allow the components to be returned to a recycling program without problems.

The oxide protective layers are not removable chemically based on their composition and structure. Using a prior oxidative chemical treatment of the oxide structure, these can be broken up and the difficult-to-dissolve oxide matrix converted to readily soluble metal oxides. This breaking up of the oxidized matrix is done by oxidation of the trivalent chromium to hexavalent chromium:

$$Fe0_{.5}Ni_{1.0}Cr_{1.5}O_4/NiFe_2O_4/Fe_3O_4 \rightarrow \text{Oxidation} \rightarrow CrO_4^{2-}, FeO, NiO, Fe_2O_3 \quad \text{Equation (1)}$$

Throughout the world, so-called permanganate preoxidation according to equation (2) has become used as an oxidation treatment, wherein the following three oxidation treatments are available:

"NP" oxidation=nitric acid+potassium permanganate (nitric acid,permanganate) (see, for example, EP-B-0 675 973)

"AP" oxidation=sodium hydroxide+potassium permanganate (alkaline,permanganate) "HP" oxidation+permanganic acid (see, for example, WO-A-2007/062743), $$\text{Mn-VII}+\text{Cr-III} \rightarrow \text{Mn-IV}+\text{Cr-VI} \quad \text{(Equation 2)}$$

The manganese ion is present in permanganate at an oxidation number of 7 and is reduced to an oxidation number of 4 according to equation (2), while at the same time the chromium, present in the trivalent oxidation state, is oxidized up to an oxidation number of. 6. According to equation (2), 2 mol $MnO^{4-}$ are required for the oxidation of 1 mol $Cr_2O_3$, Chemical decontamination of an entire primary system including all activity-carrying auxiliary systems was previously performed only in a few nuclear power plants. In recent years about 50 different decontamination methods were developed worldwide. Of all these methods, the only technologies that became widely used were those based on initial preoxidation with permanganates ($MnO^{4-}$), e.g., (EP 0 071 336, EP 0 160 831 B1, EP 242 449 B1, EP 0 355 628 B1, EP 0 753 196 B1, EP 1 082 728 B1).

Available chemical decontamination methods are fundamentally performed with the following process sequence at this time:

Step I: preoxidation step
Step II. reduction step
Step III. decontamination step
Step IV: decomposition step
Step V: final cleanup step.

All methods use permanganate (potassium permanganate, permanganic acid) for preoxidation (I.) and oxalic acid for reduction (II.). The methods only differ in the decontamination step (III.). Different chemicals and chemical mixtures are used here.

The decontamination methods to date are based on the previously explained concept. The poorly soluble oxide protective layers are converted in a preoxidation step into more readily soluble oxide compounds and remain on the surface of the system. Therefore no removal of activity from the systems to be decontaminated takes place during the preoxidation. No decrease in the radiation dose rate takes place during this time phase of decontamination with existing methods.

Only after the second process step (II.) of the reduction of the permanganate and the manganese dioxide formed with oxalic acid and in the decontamination step (III.) are the oxides dissolved and the dissolved cations/radionuclides removed and bound to ion exchange resins.

During the preoxidation (I.) in all previously used decontamination technologies, manganese oxyhydrate [$MnO(OH)_2$] and manganese dioxide ($MnO_2$) form, as is clearly shown by equations (3) and (4).

$$2MnO_4^- + Cr_2O_3 + H_2O \rightarrow 2MnO(OH)_2 + 2CrO_4^{2-} + H_2O$$

$$2MnO(OH)_2 \rightarrow 2MnO_2 + 2H_2O \quad \text{(Equation 3)}$$

(AP/HP-Oxidation)

$$4KMnO_4 + 4HNO_3 + 2Cr_2O_3 + 4H_2O \rightarrow 4MnO(OH)_2 + 4KNO_3 + 2H_2Cr_2O_7$$

$$4MnO(OH)_2 \rightarrow 4MnO_2 + 4H_2O \quad \text{(Equation 4)}$$

(NP-Oxidation)

The manganese dioxide is insoluble and deposits on the inner surface of the components/systems. With increasing manganese oxyhydrate/manganese dioxide deposition, the desired oxidation of the oxidic protective layer is impeded. In addition the converted iron and nickel oxides remain undissolved on the surface, so that the barrier layer on the surface is further thickened.

At the end of the preoxidation step, the following new chemical compounds, introduced or formed in process step (I.), are present:

On the system surface: $MnO_2$, NiO, FeO, $Fe_2O_3$, $Fe_3O_4$

In the preoxidation solution: $KMnO_4$, NaOH or $HNO_3$, colloidal $MnO(OH)_2$, $CrO_4^{2-}$ and $Cr_2O_7^{2-}$.

Thus at the end of the preoxidation step, all metal oxides including the radionuclides are still present in the system to be decontaminated. Part of the manganese oxyhydrate formed [$MnO(OH)_2$] was carried into system areas without flow passing through and can no longer be carried out/removed in the subsequent process steps.

According to the prior art, no decrease in radioactivity occurs, thus no decontamination, occurs during oxidation of the oxide layer, since practically no cations that could be removed with the aid of the cation exchanger are dissolved out of the oxide layer. Instead the breakdown of the oxide layer is accomplished in a second process step with the aid of oxalic acid, preceded by a reduction step for reducing excess permanganic acid and manganese oxyhydrate. Only after these process steps are cations removed from the cleanup solution (decontamination solution) by ion exchange.

SUMMARY OF THE INVENTION

The goal of the present invention is that of avoiding the drawbacks of the prior art, especially permitting simplification of the process sequence, wherein the formation of manganese dioxide and oxalate is to be avoided. The formation of $CO_2$ should at least be reduced. The release of oxidic particles also should be largely avoided.

According to the invention the goal is essentially accomplished in that the oxidation of the oxide layer and its dissolution takes place in a single treatment step with the aid of the aqueous decontamination solution, that sulfuric acid is used as the mineral acid for adjusting the pH, and that after decomposition of the permanganic acid, while maintaining the circulation, the solution flows over a bypass line of the circuit to a cation exchanger in which divalent cations and divalent radionuclides present in the solution are fixed, with simultaneous liberation of sulfate and dichromate anions.

According to the invention it is intended that the pH be established at the beginning of the process sequence by addition of sulfuric acid. During the oxidative decomposition of the layer and the process steps performed in this connection, no further addition of sulfuric acid is required.

In particular it is intended that after enrichment of the solution with dichromic acid at a predetermined concentration, especially 300 ppm or less, preferably 100 ppm or less, the solution will flow over a bypass line to an anion exchanger in which the dichromate will be fixed with simultaneous liberation of the $SO_4^-$ ions.

In this process the quantity of anion exchange resin used is adapted to the quantity of dichromate ions to be fixed.

According to the invention it is planned for the permanganate concentration in the oxidative decontamination solution to be adjusted such that after the predetermined dichromate concentration has been reached, the permanganate ions will have been consumed by chemical oxidation reactions, wherein in particular the following equation is applicable:

$$\text{Total consumption of } HMnO_4\ [kg] = \text{Cr-III load } [kg] \times U$$

with $1.35 \leq U \leq 1.40$, especially $U=1.38$.

According to the invention a method for breaking down the radioactivity load in components and systems is provided, wherein the oxide layers of the inner surfaces wetted with the medium are removed with an oxidative decontamination solution. In this process the oxidative decontamination can be performed with the power plant's existing systems without the aid of auxiliary external decontamination systems, the reduction of activity can take place without formation of manganese dioxide and precipitation of other cations as well as without production of $CO_2$ and without release of oxide particles, and the metal oxides can be simultaneously dissolved chemically and fixed as cations/anions together with the manganese and the nuclides (Co-60, Co-58, Mn-54, etc.) on ion exchange resins.

In contrast to the decontamination concepts described in the preceding, according to the invention the chemical transformation of the poorly soluble oxides to readily soluble oxides, the dissolution of the oxides/radionuclides and the removal and fixing of the dissolved cations on cation exchangers takes place in a single process step, which is known as the oxidative decontamination step.

Furthermore and in contrast to the prior art, according to the invention in the course of the preoxidation step the permanganic acid introduced is completely converted to the $Mn^{2+}$ cation. Manganese oxyhydrate precipitation does not take place.

Five equivalents (electrons) are made available for oxidation of $Cr_2O_3$ through the reaction of Mn-VII to Mn-II. This means that almost twice the quantity of $Cr_2O_3$ can be oxidized to chromate/dichromate according to the teaching of the invention compared with the previous decontamination methods.

In the previous permanganate-based decontamination concepts, for each 100 g permanganate ions used:

43 g Cr-III are oxidized to Cr-VI 72.5 g $MnO(OH)_2$ precipitate.

For the decontamination concept according to the present invention, per 100 g of permanganate ions used 73 g Cr-III are oxidized to Cr-VI no precipitation of $MnO(OH)_2/MnO_2$ occurs.

In contrast to the previous decontamination methods, only the following chemical compounds resulting from the oxidative decontamination step remain in the system:

on the system surface: $Fe_2O_3$ in the preoxidation solution: $H_2Cr_2O_7$ and $H_2SO_4$.

The continuing presence of $H_2Cr_2O_7$ and $H_2SO_4$ is advantageous since both of these compounds are consumed in the remaining process sequence and thus they are desirable in the process technology. The dichromate protects the basic material of the system and the component from chemical attacks, and the sulfuric acid guarantees the low pH value required over the entire process, as is also illustrated based on FIG. 1.

The hematite ($Fe_2O_3$) remaining in the system cannot be dissolved by mineral acids with oxidative properties (for example, nitric acid). Therefore in a subsequent step, a so-called hematite step, the $Fe_2O_3$ is dissolved and then the dissolved Fe ion is bound to cation exchangers.

According to the teaching of the invention both the pH and the permanganic acid and the proton source (sulfuric acid) are balanced with respect to one another according to a fixed logistical scheme in such a way that during the performance of the oxidative decontamination step:

no manganese dioxide can form the individual oxides (FeO, NiO) formed by the breakdown of the low solubility spinel/magnetite oxides are chemically dissolved simultaneously the iron and nickel salts formed have high solubility the dissolved cations ($Fe^{3+}$, $Ni^{2+}$ and $Mn^{2+}$) are fixed on ion exchangers.

The formation of manganese dioxide described in the preceding by NP, AP and HP oxidation is avoided according to the invention by using permanganic acid in the acid range ($pH \leq 2.5$, preferably $pH \leq 2.2$, especially $pH \leq 2$). The $Mn^{2+}$ formed in the acid medium in accordance with the invention is already removed from the solution by cation exchangers during the oxidative decontamination step according to equation (5):

$$\text{a) } 6HMnO_4+5Cr_2O_3+2H^+ \rightarrow 6Mn^{2+}+5Cr_2O_7^{2-}+4H_2O \quad \text{Equation (5)}$$

$$\text{b) } Mn^{2+}+H_2KIT \rightarrow [Mn^{2+}KIT]+2H^+$$

According to the invention the chemical reaction corresponding to equation (5) definitely leads to the formation of $Mn^{2+}$. The reaction is proton ($H^+$ ion)-controlled.

If not enough protons ($H^+$) are available in the course of the oxidative decontamination step, the chemical reaction proceeds according to equations (3) and (4). Manganese oxyhydrate/manganese dioxide forms as the final product.

FIG. 1 shows the correlation between the pH (=acid concentration) and the permanganate content. If the pH is exceeded in the curve shown, manganese dioxide forms during the oxidation reaction [equations (3) and (4)]. If the value drops below the curve, the reaction proceeds to the $Mn^{2+}$ cation [equation (5)].

According to the present invention the required pH of <2.5, preferably ≤2.2, preferably pH≤2.0 is established with additional sulfuric acid. Of all the available mineral acids, sulfuric acid meets the requirements for the decontamination process according to the invention, such as

- sulfuric acid is resistant to permanganate, it is not oxidatively degraded or chemically altered
- permanganic acid is not reduced by sulfuric acid; formation of manganese dioxide ($MnO_2$) does not occur
- metal oxides are dissolved and form readily soluble sulfates
- the dissolved cations are bound to cation exchange resins, and the sulfuric acid is again available for the process
- attack on the base material does not occur.

Because of the characteristics listed above, sulfuric acid remains available at the end of the oxidative decontamination step for use in successive steps.

The oxides (NiO, $Ni_2O_3$, FeO) are already dissolved by sulfuric acid during the oxidation step.

If another mineral acid should be suitable in place of sulfuric acid for accomplishing the method according to the invention, such a mineral acid will also be covered by the invention.

According to the present invention, sulfuric acid will be used for the pH adjustment. The quantity of sulfuric acid required to avoid $MnO(OH)_2$ formation is based on the permanganate concentration. With increasing permanganate concentration, the pH must be reduced, i.e., a higher acid concentration must be set (see FIG. 1).

The following pH values may be taken as guidelines:

- at 0.1 mol permanganic acid per liter, a pH of about 1,
- in the case of 0.01 mol permanganate per liter, a pH of about 2.

In accordance with the present invention, depending on the permanganate content of the solution, the sulfuric acid requirement can be calculated as follows by way of the pH:

The calculation of the $H_2SO_4$ requirement without including the dissolved cations is performed according to equations (6 and 7);

$$pH=X-[(mg/kg\ HMnO_4\ used)\times 9E\text{-}05] \quad \text{Equation (6)}$$

with 2.0≤X≤2.2, especially X=2.114

$$mg/kg\ H_2SO_4=Y\times pH^{-Z} \quad \text{Equation (7)}$$

with 16≤Y≤18, especially Y=16.836
and 4.5≤Z≤6.5, especially Z=5.296.

During the performance of the oxidative decontamination step, the concentration of free protons (H+) is reduced by the formation of metal sulfates. The quantities of dissolved Fe, Ni, Zn, and Mn cations are therefore included in the determination of the additional mineral acid requirement according to the following formula:

$$mg\ SO_4^{-2}/liter=[mg\ cation/liter]*[cation\text{-}specific\ factor].$$

The calculation of the $H_2SO_4$ requirement including the dissolved cations is performed according to equation (7').

$$mg/kg\ H_2SO_4=[y\times pH^{-z}]+[(K_1*F_1)+(K_2F_2)+\ldots(K_n*F_n)] \quad \text{Equation (7')}$$

wherein $K_1$, $K_2$ . . . $K_n$ respectively represent mg cation/liter and $F_1$, $F_2$ . . . $F_n$ is the specific factor of the respective cation.

The following applies for the cations below:

- F1 (Fe-II) between 1.70 and 1.74, especially 1.72
- F2 (Fe-III) between 2.55 and 2.61, especially 2.58
- F3 (Ni-II) between 1.62 and 1.66, especially 1.64
- F4 (Zn-II) between 1.45 and 1.50, especially 1.47
- F5 (Mn-II) between 1.70 and 1.80, especially 1.75.

Appreciable Zn fractions are present in the protective layer when the so-called Zn operating mode is carried out in the power operation of the nuclear power plant.

Depending on the Fe/Cr/Ni/Zn composition of the protective layer, according to the present invention, depending on the quantity of $HMnO_4$ used, in each case it is possible to calculate in advance the exact quantities of the individual cations released in the oxidative decontamination step. This is possible since the $HMnO_4$ quantity used is 100% converted into $Mn^{2+}$ and the quantity of dichromate generated is formed stoichiometrically. The quantity of oxidized Cr-III in turn gives the amount of Fe—/Cr—/Ni—/Zn oxides converted and thus Fe—/Ni—/Zn—/Mn ions produced in the oxidative decontamination step.

FIG. 2 shows as an example the chronological degradation of permanganic acid and the associated simultaneous buildup of the cations (Fe-II, Ni-II, Mn-II) and the anion $Cr_2O_7^{2-}$ in the oxidative decontamination solution in a system with high chromium content.

During the oxidative oxide conversion and the simultaneously proceeding dissolution of the new oxide structures, the system to be decontaminated is operated in a circuit without the involvement of an ion exchanger. This will be explained theoretically on the basis of FIG. 6. The oxidative decontamination step, which is performed in a circuit up to the time when the quantity of $HMnO_4$ is 100% converted to $Mn^{2+}$ (circuit K1) without the solution going through a cation exchanger (KIT).

Calculation of the quantity of the dissolved cation and the remaining $Fe_2O_3$ is performed according to the following formulas as a function of the quantity of permanganic acid used and the composition of the oxide matrix:

Cations dissolved in the oxidative decontamination step according to $HMnO_4$ quantity introduced:

$$[g]\ Fe\text{-}II=[g\ HMnO_4\ quantity\ introduced]\times 0.72\times[wt\ \%\ Fe]/[wt\ \%\ Cr]\times 0.33$$

$$[g]\ Ni\text{-}II=[g\ HMnO_4\ quantity\ introduced]\times 0.72\times[wt\ \%\ Ni]/[wt\ \%\ Cr]$$

$$[g]\ Zn\text{-}II=[g\ HMnO_4\ quantity\ introduced]\times 0.72\times[wt\ \%\ Zn]/[wt\ \%\ Cr]$$

$$[g]\ Mn\text{-}II=[g\ HMnO_4\ quantity\ introduced]\times 0.46.$$

Iron oxide transformed to $Fe_2O_3$ in the oxidative decontamination step per $HMnO_4$ addition is dissolved in the hematite step:

$$[g]\ Fe_2O_3=[HMnO_4\ \text{quantity introduced}]\times 0.72\times[\text{wt \% Fe}]/[\text{wt \% Cr*}]\times 0.67\times 1.43$$

According to the invention the quantity of $HMnO_4$ introduced determines the quantity of the oxide layer that can be released from the oxide matrix of the Fe/Cr/Ni protective layer. FIG. 7 shows this correlation based on an example of a system decontamination that was performed. The mean oxide protective layer thickness was approximately 5.5 μm. Altogether the oxidative decontamination step including the hematite step was performed 11 times. The diagram presented in FIG. 7 shows that the mean oxide layer degradation per $HMnO_4$ dose reproducibly fell within the order of about 0.5 μm.

According to the present invention a maximum permanganic acid concentration of 150 ppm per oxidative decontamination step is to be used, which is correspondingly repeated as a function of the previously determined or estimated chromium concentration, as was explained in the preceding.

To minimize the required use of sulfuric acid—also called merely mineral acid in the following—the oxidative decontamination step is preferably conducted with an $HMnO_4$ concentration of ≤50 ppm $HMnO_4$. The following chemical partial reactions take place during the oxidative decontamination step:

Oxidation and dissolution of $Cr_2O_3$ bound in the protective layer ($Fe_{0.5}Ni_{1.0}Cr_{1.5}O_4$):

$$6HMnO_4+5Cr_2O_3+6H_2SO_4\rightarrow 6MnSO_4+5H_2Cr_2O_7+4H_2O \qquad \text{Equation (8)}$$

Through the oxidation of the Cr-III oxide to water-soluble dichromate, Ni is released from the composite protective layer and is then present as Ni-II-oxide (NiO) or Ni-III-oxide ($Ni_2O_3$). Then the Ni oxides are dissolved in an intermediate step by $HMnO_4$ and formation of $Ni(MnO_4)_2$ according to equation (9):

$$NiO+2HMnO_4+5H_2O\rightarrow[Ni(MnO_4)_2\times 6H_2O] \qquad \text{Equation (9)}$$

With increasing $HMnO_4$ consumption, relocation of the Ni-II from Ni-permanganate to Ni-dichromate (equation 10) or Ni-sulfate (equation 11) occurs.

$$[3Ni(MnO_4)_26H_2O]+5Cr_2O_3+2NiO+6H_2SO_4$$

$$6MnSO_4+5NiCr_2O_7+12H_2O \qquad \text{Equations (10)}$$

$$NiCr_2O_7+H_2SO_4\rightarrow NiSO_4+H_2Cr_2O_7 \qquad \text{Equation (11)}$$

Through the oxidation of Cr-III oxide with formation of water-soluble dichromate, additional Fe is released from the oxide matrix and is then present as Fe-II oxide (FeO) or Fe-III oxide ($Fe_2O_3$). FeO is easily dissolved by sulfuric acid (equation 12). $Fe_2O_3$ on the other hand is not sufficiently dissolved by sulfuric acid and therefore remains in the system and is dissolved in the subsequent process step that was mentioned (the hematite step, see below) and fixed on cation exchange resins.

$$FeO+H_2SO_4\rightarrow FeSO_4+H_2O \qquad \text{Equation (12)}$$

To speed up the oxidative decontamination step, a process temperature of 60° C. to 120° C. is preferably established.

In accordance with the present invention the oxidative decontamination preferably takes place in a temperature range of 95° C. to 105° C.

After conversion of the permanganate has taken place according to equations (8) to (12), the connection of the special, power plant-specific cation exchanger is performed (KIT).

This will also be illustrated on the basis of FIG. 6. During the transformation of the permanganate to $Mn^{2+}$, the solution is circulated in the system (K1) to be decontaminated. After conversion of the permanganate the solution is passed through the cation exchanger KIT in bypass over a cleanup circuit K2.

The prerequisite for connecting in the cation exchanger is that the permanganate has been converted completely or essentially completely to $Mn^{2+}$ and the solution is free from $MnO_4^-$ ions (guideline value <2 ppm $MnO_4$).

During the operation of the cation exchanger KIT, the divalent cations (Mn-II, Fe-II, Zn-II and Ni-II) as well as the divalent radionuclides (Co-58, Co-60, Mn-54) are removed from the solution. At the same time the corresponding anions (sulfate and dichromate) are released and are again available to the process. See equations (13) and (14).

Release of the sulfate with formation of sulfuric acid:

$$MnSO_4+H_2KIT\rightarrow H_2SO_4+[Mn^{2+}\text{-KIT}]$$

$$NiSO_4+H_2KIT\rightarrow H_2SO_4+[Ni^{2+}\text{-KIT}]$$

$$FeSO_4+H_2KIT\rightarrow H_2SO_4+[Fe^{2+}\text{-KIT}]$$

$$Fe(SO_4)_3+3H_2KIT\rightarrow 3H_2SO_4+[Fe^{3+}\text{-KIT}] \qquad \text{Equation (13)}$$

Release of the dichromate with formation of dichromic acid:

$$NiCr_2O_7+H_2KIT\rightarrow H_2Cr_2O_7+[Ni^{2+}\text{-KIT}] \qquad \text{Equation (14)}$$

The cation exchanger KIT is operated at a process temperature of ≤100° C.

The cation exchanger KIT is operated until all dissolved cations are fixed on the cation exchange resin.

In accordance with the present invention, after the cation cleanup has been performed, permanganic acid is again added and the previously-explained process steps are repeated until the dichromic acid concentration has reached a prespecified value such as 300 ppm or less.

FIG. 3 shows in a purely theoretical manner the individual phases of the oxidative decontamination step, wherein the individual phases D1 to D3 are defined as follows:

D1=breakup and dissolution of the oxide matrix

D2=fixation of the dissolved cations on the cation exchanger KIT and

D3=fixation of the dichromate on the anion exchanger AIT.

In FIG. 5 the changes in the cation concentration of an oxidative decontamination step over time are shown by way of example based on three $HMnO_4$ additions.

This sequence (FIG. 3 and FIG. 5, phases D1 and D2) can be repeated until the dichromic acid concentration has reached a value of about 300 ppm.

The maximum dichromic acid concentration is preferably limited to 100 ppm.

Once the specified dichromic acid concentration has been reached, the dichromate is removed from the solution with the anion exchanger AIT (see FIG. 6—cleanup circuit K3).

The prerequisite for inclusion of the anion exchanger is that all permanganate ions have been consumed by the chemical oxidation reaction and the solution is free from permanganate ions (see FIG. 6—cleanup circuit K3).

The quantity of the anion exchanger used is based on the dichromate load in the solution to be cleaned up. Only an amount of anion exchanger is made available, the capacity of which is sufficient for uptake of the dichromate. In this way it is ensured that the sulfuric acid concentration in the solution does not change.

In the first phase of the anion exchanger cleanup, both the sulfate ions of the sulfuric acid and the dichromate ions of the dichromic acid are bound to the anion exchange resins. Once the anion exchange resin is 100% loaded with dichromate and sulfate, upon further loading of the anion exchanger with sulfate ions and dichromate ions, the already-fixed sulfate ions are displaced by dichromate ions. This process continues until the anion exchanger is 100% loaded with dichromate ions and all sulfate ions are once again available for oxidative decontamination.

If the dichromate ions are removed from the solution, permanganic acid is once again added and the process starts again as described previously (FIG. 3, phases D1, D2 and D3).

The repetition of the step sequences is continued until no further cation expulsion takes place. If, after execution of the previous sequences, all cations and anions are fixed on ion exchangers, only sulfuric acid is still present in the solution.

It is customary according to the prior art, after preoxidation is complete, to reduce the excess permanganate with oxalic acid (step (II.) and then initiate the decontamination step (step III.) by addition of further decontamination chemicals.

At the time of the reduction (step II.) in these methods, all constituents of the preoxidation step (residual permanganate, colloidal $MnO(OH)_2$, chromate and nickel permanganate) as well as all transformed metal oxides on the system and component surface are still present in the solution.

Since the metal ions can be present, partially in dissolved form ($MnO_4^-$, $CrO_4^{2-}$) and as readily soluble metal oxides (NiO, FeO, $MnO_2/MnO(OH)_2$), even during the second process step of the reduction (step II.), high cation contents appear in the solution.

At the same time, as a result of reduction of the permanganate, chromate and manganese dioxide with the oxalic acid, large amounts of $CO_2$ form (see equation (15)). This $CO_2$ formation occurring on the surface leads to mobilization of oxide particles, which then deposit in regions of the system with little flow and lead to an increase in the dose rate there.

$$2HMnO_4+7\ H_2C_2O_4 \rightarrow 2MnC_2O_4+10CO_2+8H_2O$$

$$MnO_2+2H_2C_2O_4 \rightarrow MnC_2O_4+2CO_2+2H_2O$$

$$Cr_2O_7^{2-}+3H_2C_2O_4+8(H_3O)^+ \rightarrow 2Cr^{3+}+6CO_2+15H_2O \quad \text{Equations (15)}$$

The release of oxide particles described in the preceding does not occur with the invention. At the time of the oxalic acid addition both the solution and the system surface are free from permanganate, manganese dioxide and chromate/dichromate. The unwanted $CO_2$ evolution and release of oxide particles do not occur.

The oxalate compounds formed from divalent cations and the reduction chemical oxalic acid have only limited solubility in water. Depending on the process temperature, the solubility of the divalent cations is:

| | 50° C. | 80° C. | Units |
|---|---|---|---|
| $NiC_2O_4$ | Approx. 3 | Approx. 6 | mg Ni-II/liter |
| $FeC_2O_4$ | Approx. 15 | Approx. 45 | mg Fe-II/liter |
| $MnC_2O_4$ | Approx. 120 | Approx. 170 | mg Mn-II/liter |

It can be calculated that large quantities of cations are released during a primary system decontamination using the previous decontamination methods in each decontamination cycle. Even during the reduction step this results in oxalate precipitation on the inner surfaces of the system.

The oxide protective layers of a primary system of a pressurized water nuclear power plant usually provide an overall oxide load of 1,900 kg to 2,400 kg [Fe,Cr,Ni-oxide].

In the decontamination of a primary system of a pressurized water reactor, therefore, the following maximum cation releases must be anticipated:

Chromium→70 to 80 kg Cr

Nickel→100 to 120 kg Ni

Iron→190 to 210 kg Fe

During the primary system decontamination 3 decontamination cycles are usually performed. At an overall volume of about 600 $m^3$ and a uniform distribution of cations over 3 cycles, the following concentrations of divalent cations per cycle are to be expected:

Nickel→67 ppm Ni

Iron→117 ppm Fe

This rough calculation shows that in all previous decontamination methods which use oxalic acid for reduction and/or decontamination, formation of $Fe^{2+}$ and $Ni^{2+}$ oxalates cannot be avoided.

As was previously discussed, if oxalate residues remain in the system after the end of a decontamination cycle, more permanganate must be used in the next cycle, as equations (16) show:

$$3NiC_2O_4+2HMnO_4+H_2O$$

$$3NiO+2MnO(OH)_2+6CO_2$$

$$3FeC_2O_4+2HMnO_4+H_2O$$

$$3FeO+2MnO(OH)_2+6CO_2 \quad \text{Equation (16)}$$

With no improvement in the decontamination result, this leads to a higher permanganate demand and consequently to increased $MnO(OH)_2$ deposition on the surfaces and ultimately to a higher production of radioactive waste. In addition the cation carryover into the following cycle increases, the risk of further oxalate formation rises, and the amount of ion exchange resins is increased again.

The already dissolved radionuclides (Co-58, Co-60, Mn-54) are incorporated into the oxalate layer. This leads to recontamination in the systems.

As was previously described, according to the present invention the divalent cations released (Ni, Mn, Fe, Zn) and the dichromate are present in dissolved form in the oxidative decontamination step and the fixation of the cations and anions takes place at a nearby time on the ion exchange resin. The oxalate deposition that previously occurred during performance of chemical decontamination does not take place.

At the end of the oxidative decontamination step sequences, the hematite step is performed. In this process step the hematite ($Fe_2O_3$) is dissolved according to equation (17):

$$Fe_2O_3+6H_2C_2O_4 \rightarrow 2[Fe(C_2O_4)_3]^{3-}+3H_2O \quad \text{Equation (17)}$$

Because of the sulfuric acid underlayering, the solubility of the Me-II oxalates in the hematite step is distinctly higher than in the other decontamination technologies.

$Ni^{2*}$ oxalate→approx. 0.80 mg Ni-II/liter $Fe^{2+}$ oxalate→approx. 150 mg Fe-II/liter.

The formation of oxalates and their deposition on the interior surfaces of the system does not take place because of the low Me-II cation concentrations and the distinctly higher solubility of the Me oxalates.

The oxalic acid concentration in the hematite step should be 50 to 1000 ppm $H_2C_2O_4$.

An oxalic acid concentration of ≤100 ppm should preferably be established.

During the hematite step, the dissolved cations are bound to cation exchangers. Here, the dissolution of the hematite and the fixation of the dissolved Fe ions are performed simultaneously (see FIG. 4—Phases of the Hematite Step).

The hematite step is continued until no further iron is removed from the system.

After the end of the hematite step, the oxalic acid remaining in the solution is decomposed with permanganic acid, forming carbon dioxide (equation 18)).

$$5H_2C_2O_4+2HMnO_4+2H_2SO_4 \rightarrow 2MnSO_4+10CO_2+8H_2O \quad \text{Equation (18)}$$

Following performance of the hematite step, the total step sequence of oxidative decontamination can be repeated. This repetition is directed toward residual $Cr_2O_3$ still to be dissolved in the system. After the second oxidative decontamination step, another hematite step is performed.

Each nuclear power plant has its own specific oxide structure, oxide composition, dissolution behavior of the oxides and oxide/activity load. Only assumptions can be made in planning a decontamination. Only during performance of the decontamination will it then be found whether the assumptions initially made were correct.

Therefore a decontamination concept must be capable of being adapted to the respective changes during its performance.

With the present invention it is possible to react systematically to all conceivable new requirements. The detailed steps shown above can be repeated as necessary depending on the type and quantity of the oxide/activity load present in the system.

Decontamination according to the present invention requires only low chemical concentrations compared to the previous process technologies. The required quantities of chemicals therefore can be added with the built-in metering systems already present in nuclear power plants (NPP), and the cations obtained can be removed using the cleanup system already present in the NPP (ion exchanger). No large external decontamination equipment need be installed.

By controlling the overall process from the power plant control room of the nuclear power plant, the process parameters can be quickly adapted to any new requirements (chemical addition rate, chemical concentrations, process temperature, time of KIT and AIT exchanger connection into the circuit, sequence of steps, etc.).

If necessary the process variations can be continued until the desired activity removal or the desired reduction in dose rate has been achieved.

The sulfuric acid present in the solution remains in solution during the performance of all process steps. The concentration is not changed. Only at the end of the overall decontamination performance are the sulfate ions bound to the anion exchanger AIT during the final cleanup (see FIG. 4, AIT cleanup step D6).

Additional details, advantages and features of the invention can not only be obtained from the claims—individually and/or in combination—but also from the drawings, described previously and also explained further below, which are self-explanatory.

DESCRIPTION OF THE PREFERRED EMBODIMENTS

Figure 1:
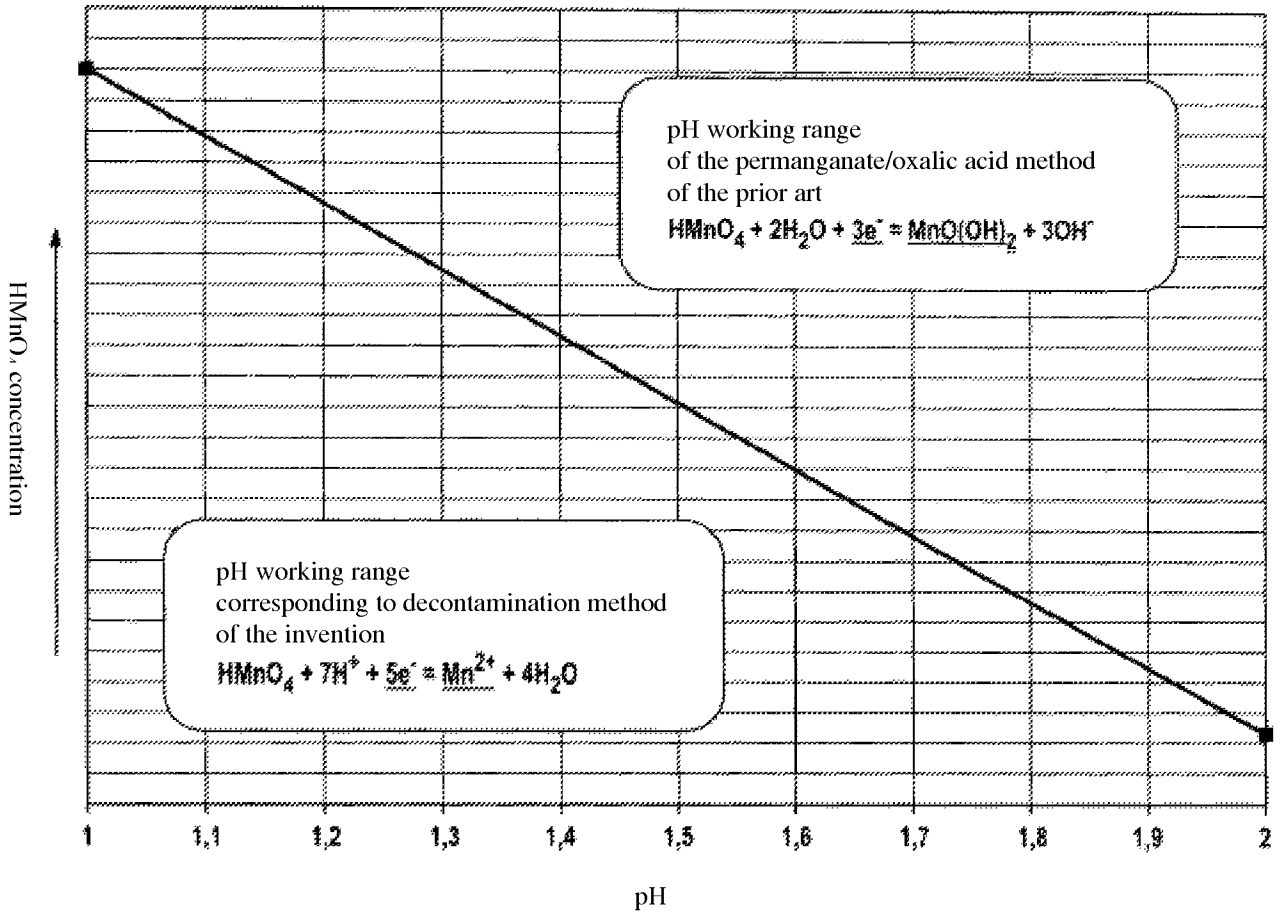
FIG. 1 the working pH range according to the invention compared to the prior art, FIG. 2 change in the permanganic acid concentration and the cation and dichromic acid concentrations as a function of the process duration, FIG. 3 the process sequence in the oxidative decontamination step, FIG. 4 the process sequence for the hematite step including the final cleanup step, FIG. 5 sequential oxidative decontamination steps and increase in dichromic acid as a function of the number of sequential oxidative decontamination steps in the case of dichromic acid remaining in the solution, FIG. 6 theoretical representation of the decontamination circuit as well as the ion exchange cleanup circuit and FIG. 7 removal of an oxide layer as a function of the number of oxidative decontamination steps performed.

It is clear from FIG. 1 that when the pH as a function of the permanganate acid concentration lies below the oblique line drawn in FIG. 1, definitely no manganese dioxide can form. According to the prior art, the process is performed at a pH and a permanganate acid concentration that lies above the straight line. As a result, manganese dioxide forms. The straight line is therefore determined according to equations (6) and (7) or (7').

Figure 2:
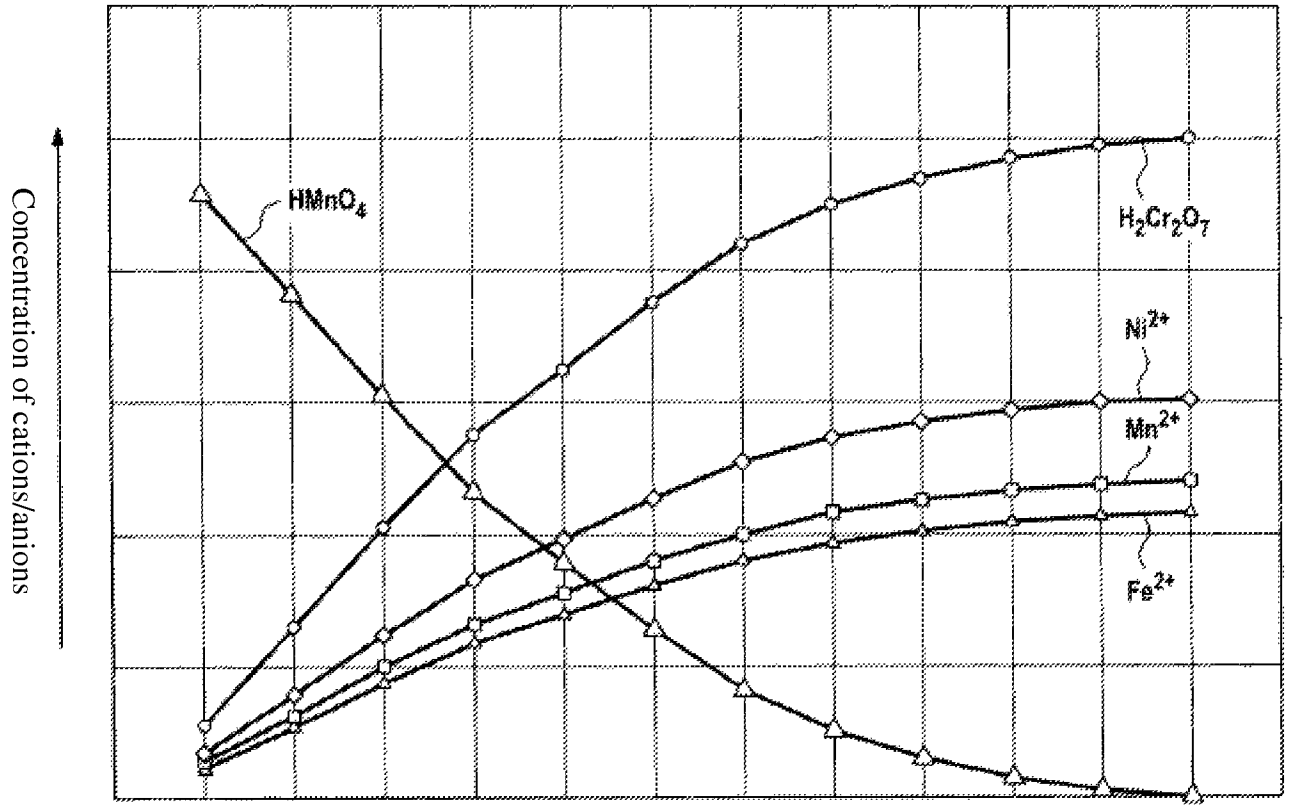

FIG. 2 shows that depending on the process in time and conversion of the permanganate to $Mn^{2+}$ the concentration of the cations and the dichromic acid increases.

Figure 3:
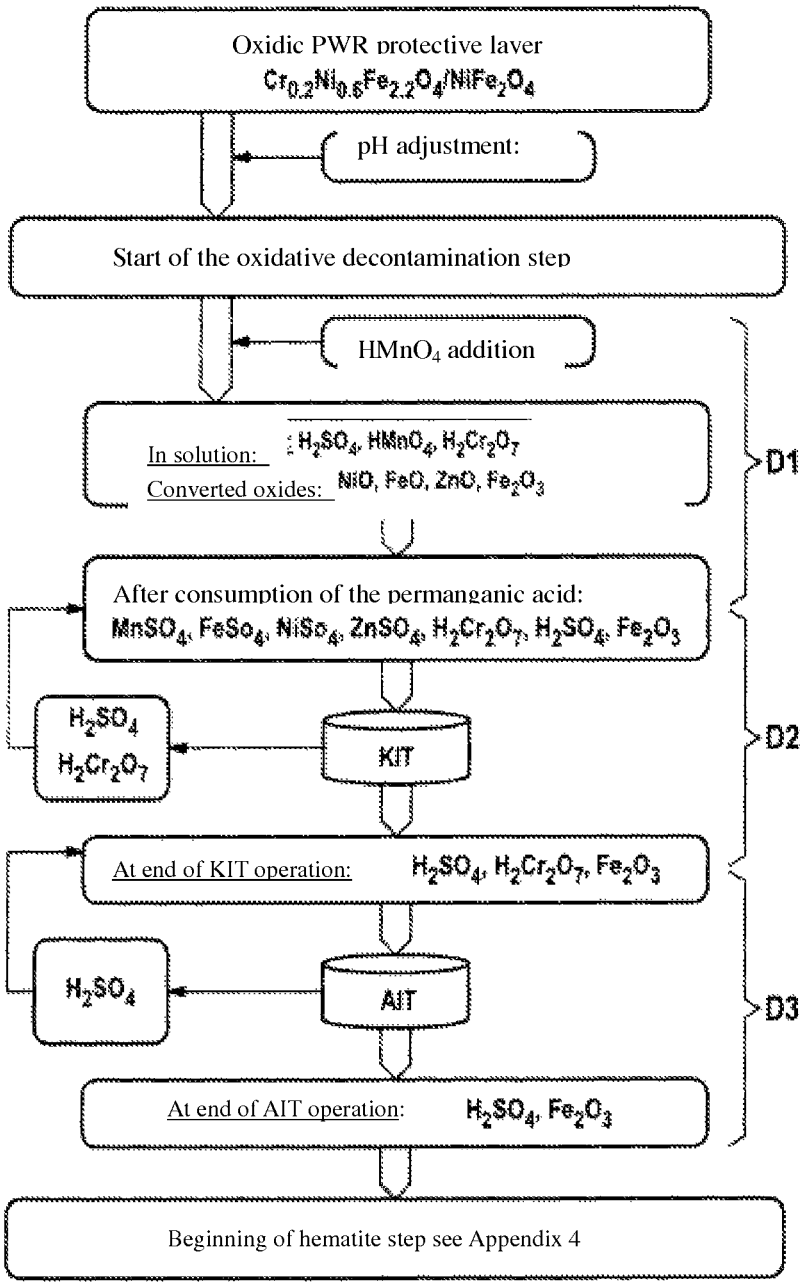

FIG. 3 shows the oxidative decontamination according to the invention in a purely theoretical aspect. In process step D1, permanganic acid is added to the solution depending on the pH established by the sulfuric acid according to equations (6, 7, 7') to dissolve the metal oxides and form readily soluble sulfates. The Cr-III oxide is oxidized to Cr-VI and is present in the solution as dichromic acid. After the permanganate has been converted completely or essentially completely to $Mn^{2+}$ and the solution is substantially free from $MnO^{-4}$ ions, the solution flows over a bypass to the cation exchanger KIT, in which the cations are fixed. Sulfuric acid and dichromic acid remain in the solution.

Then once again permanganic acid is added to the solution, which is no longer flowing through the cation exchanger, corresponding to the $Cr^{-3}$ oxide to be oxidized. Addition of sulfuric acid is not necessary as long as the quantity per kg solution is calculated according to equations (7) and (7'). After the dichromic acid concentration has reached a predetermined value, the solution flows over the bypass through the anion exchanger AIT, in which dichromate ions are fixed in the previously described manner. Then sulfuric acid and hematite remain in the solution.

Figure 4:
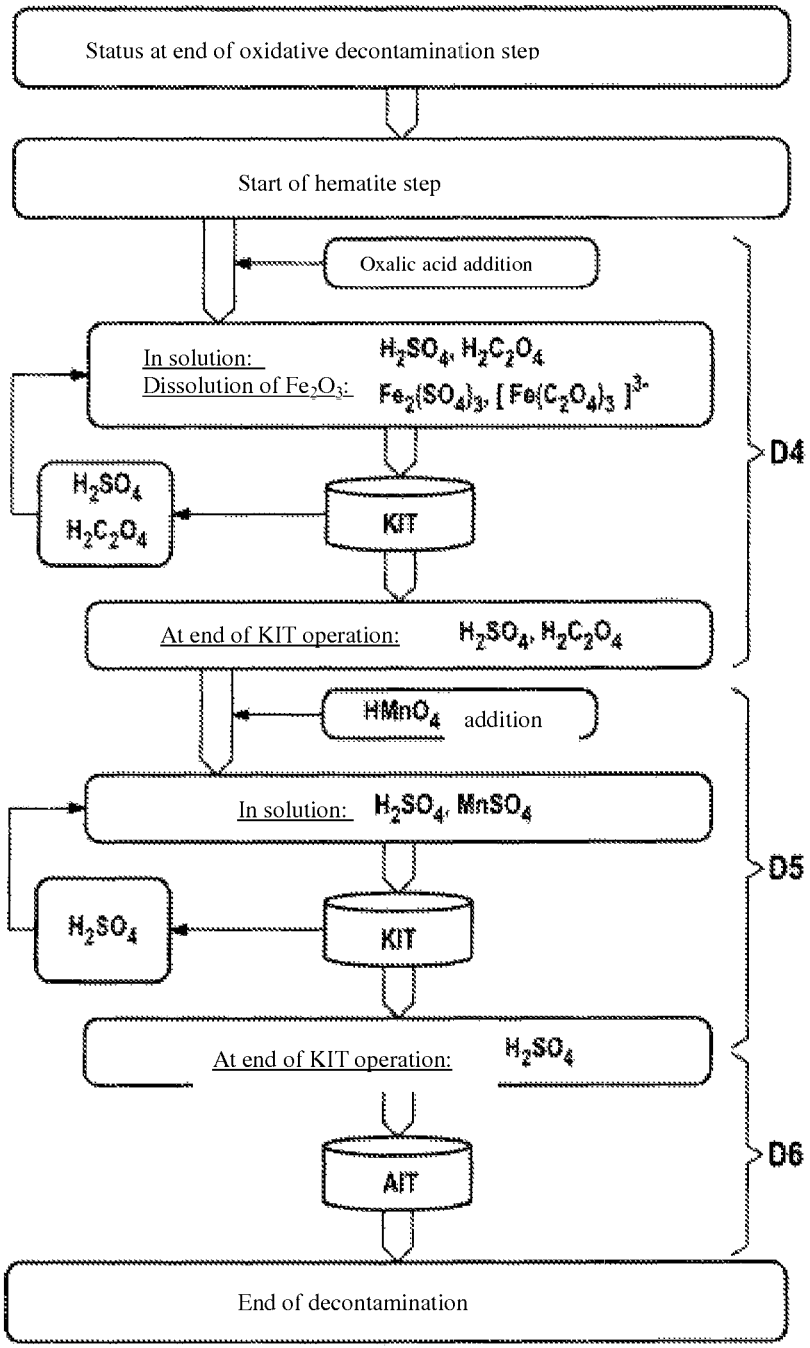
Figure 5:
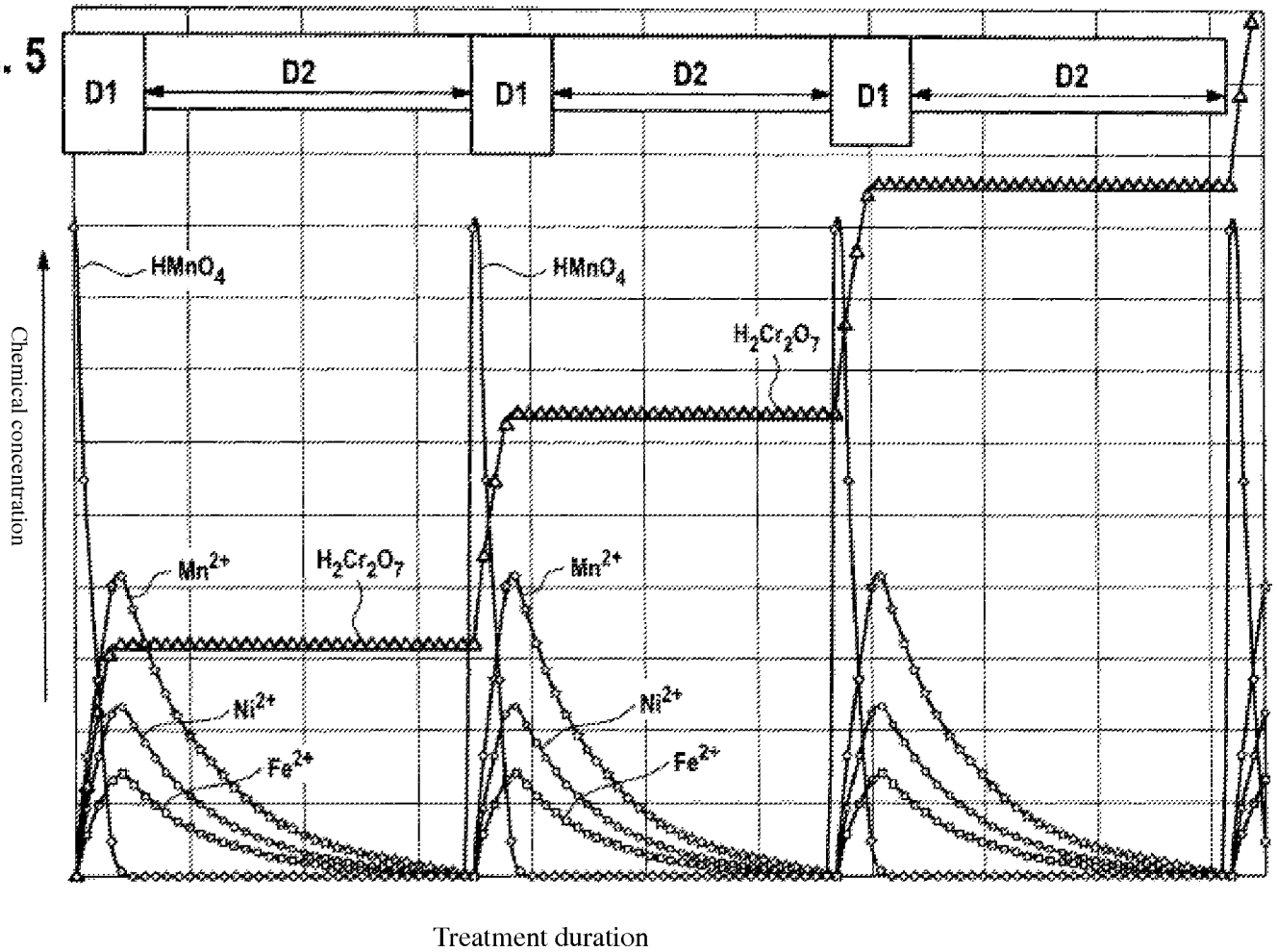

The hematite is removed from the solution according to FIG. 4. For this purpose, first oxalic acid is added (process step D4). The solution flows through a cation exchanger KIT, wherein the dissolution of the hematite and the fixing of the Fe ions are performed simultaneously. This process step D4 is performed until no further iron is removed. Then permanganic acid is added in process step D5 to decompose the oxalic acid, forming carbon dioxide, and the manganese sulfate that forms is removed with cation exchangers. Then only sulfuric acid remains in the solution.

Figure 7:
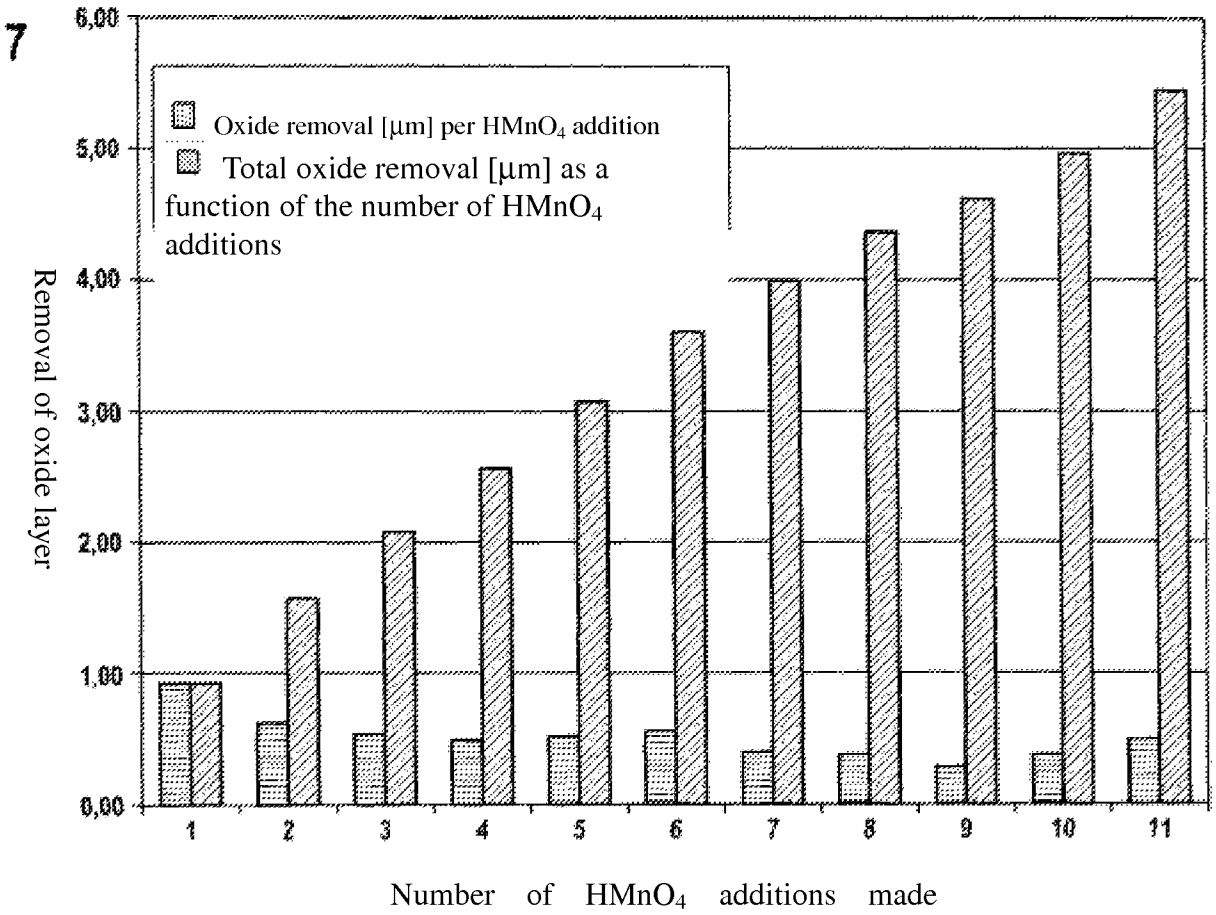

FIG. 7 shows, purely theoretically, that the oxide layer can be removed layer by layer, specifically depending on the number of oxidative decontamination steps performed, thus the addition of $HMnO_4$. It is recognized that oxide layers at thicknesses of approximately 0.3 μm to 0.6 μm are removed per oxidative decontamination step.

Figure 6:
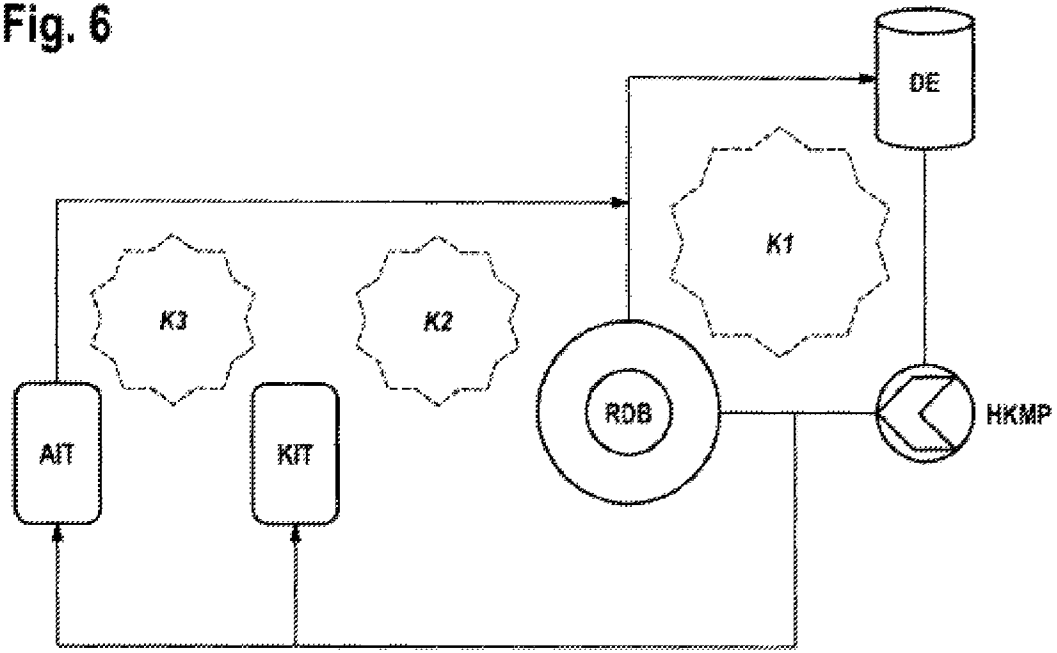

In process step D1, chemical conversion of the low solubility Fe, Cr, Ni structure into readily soluble oxide forms takes place with the aid of permanganic acid. The dissolution of the converted oxide forms is achieved with sulfuric acid. In terms of process technology, this is performed in a circulating operation K1 (FIG. 6) in a sulfuric acid-permanganic acid solution. The circulating operation K1 is maintained until the permanganic acid is completely consumed and converted to $Mn^{2+}$. The transformation of the permanganic acid to $Mn^{2+}$ is usually 2 to 4 hours if the permanganic acid concentration at the beginning of the process is set at less than 50 ppm, especially in the range between 30 and 50 ppm. The conversion of the oxide structure and the dissolution of the converted oxides take place simultaneously. The final products of the dissolution process are sulfate salts. After the end of the D1 phase, the D2 phase begins. In this process metal cations present as sulfate salts are passed over the cation exchanger KIT and fixed there. In this exchange process the sulfate is released again and is available to the decontamination solution.

During phase D2—just as during phase D1—the circulating operation K1 is maintained unchanged and the connection of the cation exchangers is done in bypass operation. The cleanup rate (flow rate) through the cation exchanger ($m^3$/h) relative to the total volume of the system to be decontaminated [$m^3$] is predetermined from the respective system design of the nuclear power plant. The bypass operation K2 with ongoing circulation operation K1 of the cation exchanger is continued until all cations are bound to the cation exchanger KIT. The total time required for this is predetermined by the available cleanup rate.

After the end of phases D1 and D2, a process technology hold point is provided. The further process steps are directed toward the total oxide content of the system to be decontaminated. If large amounts of chromium are present in the oxide matrix, it is advisable to repeat phases D1 and D2. This repetition process D1+D2 can be continued until the dichromate concentration in the decontamination solution has reached a value of, for example, 100 ppm dichromate. Then process step D3 follows. At the time of phase D3, sulfuric acid and dichromic acid are present in the decontamination solution. The dichromic acid is removed from the solution by means of bypass operation of an anion exchanger. During phase D3 the circulating operation K1 of the system to be decontaminated is operated further without change. The addition of the anion exchange circuit K3 is done in bypass operation. The bypass range of the cation exchange circuit K2 can also be further operated. The bypass operation K3 of the anion exchanger is continued until the dichromate ions are bound to the anion exchanger AIT. The time required for this is determined by the available cleanup rate. The reduction of the dichromate concentration is advantageously continued up to a final concentration of less than 10 ppm. Through the persistence of small quantities of dichromate in the solution, the properties of dichromate for protecting the base material are maintained.

After the end of phase D3, a second process technology hold point is programmed. In the course of the hold point 2, the further procedure is determined, including the considerations described below. The additional process steps are directed toward the total oxide load of the system to be decontaminated. If a large oxide load is present, the process sequence D1 to D3 must be repeated several times before the hematite step is initiated, wherein the number of sequences D1 to D3 is preferably limited to a maximum of 4 times. In the hematite step, designated as phase D4, the hematite $Fe_2O_3$ produced in the oxidative decontamination step is dissolved in a sulfuric acid-oxalic acid solution. At the same time, fixation of the dissolved iron on the cation exchanger KIT takes place. Sulfuric acid and oxalic acid are again released from the beginning by cation withdrawal, and are continuously available for the hematite solution process. During the total phase D4 both the circulating operation K1 of the system to be decontaminated and the cation exchange circuit K2 are operated. The connection of the cation exchange circuit K2, in which the iron is fixed, takes place in bypass operation. The hematite dissolution phase, thus phase D4, is operated until no further appreciable iron removal takes place.

In the subsequent process step D5, in which sulfuric acid and oxalic acid are present, the oxalic acid is degraded oxidatively to $CO_2$. The oxidative degradation is accomplished by means of $HMnO_4$. In this process only the circuit K1 is operated, without the cation exchanger K2 or the anion exchanger K3 having flow through it. After degradation of the oxalic acid, sulfuric acid and Mn sulfate are present in the solution. Only after degradation has taken place will the $Mn^{2+}$ be bound to the cation exchanger by connecting in circuit K2.

After the end of the hematite step a process technology hold point 3 is programmed in. During the hold point 3 the further procedure is determined. The continuing process steps are based on the total oxide load of the system to be contaminated. If a large oxide load is present, process steps D1 to D5 must be repeated until the desired decontamination result (dose rate reduction) has been reached. When this occurs, the final cleanup step will be performed. Chemically this means that sulfuric acid is removed from the system. This is performed with anion exchange resins D6. During process step D6 both the large circulating operation K1 of the system to be decontaminated and the anion exchange circuit K3 are operated. The bypass operation K3 of the anion exchanger is continued until the sulfate ions are bound to the anion exchanger ATT. The total time required for this is predetermined by the available cleanup rate.

Repetition of the individual phases D1 to D6 in and of themselves does not occur. Instead, process steps D1+D2 or D1+D2+D3 or D1+D2+D3+D4 or D1+D2+D3+D4+D5 are repeated several times.

The invention claimed is:

1. A method for dissolving an oxide layer comprising chromium, iron, nickel, and radionuclides, the method comprising:

providing an aqueous oxidative decontamination solution containing permanganic acid and sulfuric acid, flowing in a circuit, wherein the oxidative decontamination solution is adjusted to a pH ≤2.5;

wherein, in a first process step, the oxide layer is oxidized in layers and dissolved by circulating the decontamination solution;

wherein, after complete consumption of the permanganic acid, with the circulation continuing, the oxidative decontamination solution is carried, in a second process step, over a bypass line through a cation exchanger to bind divalent Fe, Ni, Zn, and Mn cations present in the decontamination solution, after which, permanganic acid is added to the decontamination solution;

wherein the first and second process steps are repeated cyclically until a preset dichromic acid concentration is present in the oxidative decontamination solution, and, in a third process step, while continuing the circulation, the decontamination solution is sent over the bypass line to an anion exchanger to bind dichromate;

wherein the first, second, and third process steps are repeated cyclically until a preset thickness of the oxide layer has been removed;

wherein, in a fourth process step, by adding a carboxylic or dicarboxylic acid, the circulating sulfuric acid solution is conveyed over the bypass line through the cation exchanger in which Fe ions are bound with a simultaneous liberation of carbonate, dicarbonate, or oxalate and sulfate ions.

2. The method according to claim 1, wherein the dichromate is bound in the anion exchanger with simultaneous liberation of the sulfate ions.

3. The method according to claim 1, wherein a quantity of anion exchange resin used in the anion exchanger is selected based on the quantity of dichromate ions to be retained on the anion exchange resin.

4. The method according to claim 1, wherein permanganate ions concentration in the oxidative decontamination solution is set such that when a prespecified dichromate ion concentration is reached, the permanganate ions are consumed by chemical oxidation reactions, wherein the following equation applies:

$$\text{total consumption of } HMnO_4\ [kg] = \text{Cr-III load}\ [kg] \times U \text{ with } 1.35 \leq U \leq 1.40.$$

5. The method according to claim 1, wherein, in the oxidative decontamination solution, the permanganic acid is set at a maximum concentration of 150 ppm.

6. The method according to claim 1, wherein the sulfuric acid in the oxidative decontamination solution is regenerated by removing Mn-II/Fe-II/Fe-III/Ni-II ions using the cation exchanger.

7. The method according to claim 1, wherein the dichromic acid formed during the degradation of the oxide layer is actively involved in the decontamination process.

8. The method according to claim 1, wherein oxalic acid is used as the dicarboxylic acid, and, after complete removal of the iron ions, the oxalic acid is oxidized to carbon dioxide with permanganate, and the Mn cations formed are bound on the cation exchanger.

9. The method according to claim 1, wherein, at the beginning of degradation of the oxide layer, the pH is adjusted with sulfuric acid, and no more sulfuric acid is added during the degradation of the oxide layer and performance of the further process steps.

10. The method according to claim 1, wherein the oxide layer further comprises zinc.

11. The method according to claim 1, wherein the oxide layer is an oxide layer formed on an inner surface of a coolant circuit of a nuclear power plant, or of a component of the nuclear power plant.

12. The method according to claim 1, wherein the preset dichromic acid concentration is 300 ppm, or less.

13. The method according to claim 1, wherein the preset dichromic acid concentration is 100 ppm, or less.

14. The method according to claim 1, wherein the dicarboxylic acid is oxalic acid.

15. The method according to claim 1, wherein permanganic acid is added to the oxidative decontamination solution to re-establish the initial concentration.

16. The method according to claim 1, wherein a quantity of sulfuric acid used is calculated according to the pH in the oxidative decontamination solution depending on the amount of permanganic acid used, and the permanganic acid quantity requirement is calculated based on the expected amount of chromium to be oxidized according to the equations:

$$pH = X - [(mg/kg\ HMnO_4\ used) \times 9E\text{-}05]$$

with $2.0 \leq X \leq 2.2$, and $$mg/kg\ H_2SO_4 = Y \times pH^{-Z}$$

with $16 \leq Y \leq 18$, and $4.5 \leq Z \leq 6.5$, if dissolved cations in the oxidative decontamination solution are not taken into consideration, or $$mg/kg\ H_2SO_4 = [Y \times pH^{-Z}] + [(K_1 * F_1) + (K_2 F_2 + \ldots (K_n * F_n)]$$

if dissolved cations in the oxidative decontamination solution are taken into consideration, wherein $16 \leq Y \leq 18$, and $4.5 \leq Z \leq 6.5$, and $F_1$, $F_2 \ldots F_n$ is a specific factor of respective cations.

17. The method according to claim 16, wherein the specific factor (F) for the cations below is determined as follows:

F1 (Fe-II) between 1.70 and 1.74,

F2 (Fe-III) between 2.55 and 2.61,

F3 (Ni-II) between 1.62 and 1.66,

F4 (Zn-II) between 1.45 and 1.50,

F5 (Mn-II) between 1.70 and 1.80.

18. The method according to claim 1, wherein the permanganic acid concentration is set such that an oxide layer with a thickness of between 0.3 μm and 0.6 μm is removed until the permanganic acid is completely consumed.

19. The method according to claim 18, wherein the thickness of the oxide layer to be removed is governed by the quantity of permanganic acid used.

20. The method according to claim 1, wherein the first, second, and third process steps are carried out at a temperature between 60° C. and 120° C.

21. The method according to claim 20, wherein the first, second, and third process steps are carried out at a temperature between 95° C. and 105° C.

22. The method according to claim 1, wherein the pH is adjusted with sulfuric acid to a value <2.2.

23. The method according to claim 22, wherein the pH is adjusted to ≤2.0.

24. The method according to claim 1, wherein, after hematite present in the oxidative decontamination solution after fixation of the dichromate in the anion exchanger, the hematite is dissolved by the addition of the carboxylic or dicarboxylic acid, the dissolved Fe ions are bound in the cation exchanger.

25. The method according to claim 24, wherein the dicarboxylic acid is oxalic acid, and wherein the oxalic acid is set at a concentration of between 50 ppm and 1000 ppm.

26. The method according to claim 25, wherein oxalic acid remaining in the oxidative decontamination solution after complete removal of Fe ions is decomposed with permanganic acid, forming $CO_2$ and $Mn^{2+}$, and the $Mn^{2+}$ ions are fixed on the cation exchanger.

27. The method according to claim 24, wherein the removal of the hematite is carried out at a temperature between 60° C. and 120° C.

28. The method according to claim 27, wherein the removal of the hematite is carried out at a temperature between 95° C. and 105° C.

* * * * *